US011065530B2

(12) United States Patent
Brown

(10) Patent No.: US 11,065,530 B2
(45) Date of Patent: Jul. 20, 2021

(54) OVERLAY FOR COLLECTIBLE TRADING CARDS

(71) Applicant: Chad Brown, Madison, WI (US)

(72) Inventor: Chad Brown, Madison, WI (US)

( * ) Notice: Subject to any disclaimer, the term of this patent is extended or adjusted under 35 U.S.C. 154(b) by 0 days.

(21) Appl. No.: 16/661,555

(22) Filed: Oct. 23, 2019

(65) Prior Publication Data

US 2020/0122019 A1 Apr. 23, 2020

Related U.S. Application Data

(60) Provisional application No. 62/749,492, filed on Oct. 23, 2018.

(51) Int. Cl.

| | |
|---|---|
| ***A63F 1/10*** | (2006.01) |
| ***B44F 1/06*** | (2006.01) |
| ***B44F 1/10*** | (2006.01) |
| ***B65D 65/10*** | (2006.01) |
| *A63F 1/06* | (2006.01) |
| *A63F 1/04* | (2006.01) |
| *A63F 9/06* | (2006.01) |

(52) U.S. Cl.

CPC ..... *A63F 1/10* (2013.01); *B44F 1/06* (2013.01); *B44F 1/10* (2013.01); *B65D 65/10* (2013.01); *A63F 1/06* (2013.01); *A63F 1/062* (2013.01); *A63F 2001/0475* (2013.01); *A63F 2009/0615* (2013.01); *A63F 2009/0616* (2013.01); *A63F 2009/0619* (2013.01)

(58) Field of Classification Search

CPC ..... A63F 1/10; A63F 1/06; A63F 2001/0475; A63F 1/062; A63F 2009/0615; A63F 2009/0616; A63F 2009/0619

USPC ..... 273/244.2, 244.1, 244, 247, 293, 298, 273/148 A, 148 R

See application file for complete search history.

(56) References Cited

U.S. PATENT DOCUMENTS

| | | | | |
|---|---|---|---|---|
| 2,634,132 | A * | 4/1953 | Freedman | A63F 1/02 273/295 |
| 5,071,136 | A * | 12/1991 | Lott | A63F 3/00041 273/259 |
| 5,201,525 | A * | 4/1993 | Castro | A63F 1/02 273/293 |
| 5,318,306 | A * | 6/1994 | Levin | A63F 1/02 273/292 |
| 9,616,323 | B2 * | 4/2017 | Gilson | A63F 1/00 |
| 2010/0253059 | A1 * | 10/2010 | Hansen | B42D 25/23 283/75 |
| 2011/0056101 | A1 * | 3/2011 | Basso | A63F 1/02 40/124.191 |
| 2017/0096270 | A1 * | 4/2017 | Jauregui | A63F 1/10 |

* cited by examiner

*Primary Examiner* — Benjamin Layno

(74) *Attorney, Agent, or Firm* — Wozny IP Law; Thomas M. Wozny

(57) ABSTRACT

An overlay having artwork printed thereon in a strategic location such that when placed over the front face of a card changes the look and appearance of the original artwork on the front face of the card. The overlay may be used with any type of card, but is preferably used with playing cards and trading cards, and is most preferably used with collectible trading cards.

6 Claims, 5 Drawing Sheets protective covering with aesthetic design

Aesthetically different card due to protective covering

Generic playing card

Alter Sleeve protective covering with aesthetic design

Aesthetically different card due to protective covering protective covering with aesthetic design Aesthetically different card due to protective covering

OVERLAY FOR COLLECTIBLE TRADING CARDS

BACKGROUND OF THE INVENTION

The present invention relates to cards such as playing cards and trading cards, and more specifically to an overlay for a card, preferably for a playing card or trading card, which changes the look and appearance of the card but not its function.

A conventional deck of playing cards includes fifty two individual cards each measuring about 3.5 inches by 2.5 inches. Such cards are typically composed of thin cardboard or pasteboard stock having a generic geometric pattern printed on their back faces, and pictorial, graphics and text on their front faces representative of their value when playing card games such as poker, bridge, euchre, hearts, sheepshead, Uno and other recreational card games.

Trading cards are also well known. Various forms of trading cards have been popular over the years, especially sports trading cards relating to baseball, football, basketball and hockey. Such a card typically has a photograph or likeness of a sports figure on its front face, and statistical information about the pictured sports figure on its back face. Although such cards are referred to as "trading" cards, they are today more frequently referred to as "collectible" cards or simply "collectibles."

A hybrid type of card is one that is used in what is commonly referred to as a collectible card game. A collectible card game is a strategy card game that utilizes specially designed sets of cards having proprietary artwork or designs on one face to embellish the card. The artwork may depict fantasy or science fiction genres, horror themes, cartoons, aliens, and the like. Each card also usually has text printed thereon used to strategically interact with other cards during play. Successful collectible card games typically have thousands of unique cards, and as one example, the game "Magic: The Gathering" has over 17,000 distinct cards.

When playing a collectible card game, players acquire cards and organize them into a personal collection from which they create customized decks of cards and challenge other players in matches and tournaments. However, cards that are worn are considered to be marked, and therefore cannot be used, especially in tournament decks. As a result, plastic card sleeves are used to protect game cards from wear and tear. A card sleeve, sometimes also referred to as a card protector, is a card-sized envelope or outer sheath of clear plastic, such as polypropylene, having a front panel attached at its periphery to a rear panel with either its top end open, referred to as a top-loading card sleeve, or one of its sides open, referred to as a side-loading card sleeve, forming a slot so that a player may slide or insert a card therein. Card sleeves are specifically dimensioned to snugly hold and protect a game card. Although some card sleeves are transparent front and back, others have non-transparent backs in black, yellow or other colors, and still others have pictorial and graphic images on their back panels. Card sleeves with opaque backs obscure the actual back of the game card and thus allow worn cards to be used without being accused of "marking" the card.

Many enthusiastic players of collectible card games invest considerable amounts of money to buy collectible cards and play in tournaments. Accordingly, many players desire to not only protect their cards from wear and tear, but also to personalize or customize the look and appearance of their cards in unique and non-permanent ways.

SUMMARY OF THE INVENTION

The present invention is an overlay having artwork printed thereon in a strategic location such that when placed over the front face of a card changes the look and appearance of the original artwork on the front face of the card. The overlay may be used with any type of card, but is preferably used with playing cards and trading cards, and is most preferably used with collectible trading cards.

The overlay of the present invention enables a card player, especially a player of a collectible card game, to not only protect a game card but also to personalize or customize the game card. In order to accomplish protection as well as personalization, players can customize their favorite cards in a unique and non-permanent way by printing artwork or any other desired design onto one side of a clear plastic overlay and then partially covering the front face of the playing card or trading card with the overlay. The artwork or design is printed on one side of the clear overlay in a manner and location such that it alters or changes the look and appearance of the front face of the playing card or trading card when the overlay covers the front face of the card, but not its function.

In a first embodiment, the clear overlay with printed artwork or designs strategically located on one side thereof is the front panel or front face of the card sleeve itself. Thus, the artwork or design on the front panel or front face of a plastic card sleeve is positioned in a manner and location that alters or changes the look and appearance of the front face of the playing card or trading card when the playing card or trading card is inserted into the card sleeve. These altered sleeves, with desired custom artwork and design printed on their front panel or face, allow for minor or major aesthetic changes to the look and appearance of the front face of the playing card or trading card, and further enable players to easily change the look and appearance of the playing card or trading card by simply inserting the card into another altered sleeve having different artwork or designs thereon. The altered sleeve may be of the top-loading type or of the side-loading type, and the artwork or design may be on either or both of its front or rear panels.

In a second embodiment, the clear overlay with artwork or designs strategically located on one side thereon is in the form of a single sheet of thin plastic transparent material, such as polypropylene. The plastic sheet is used by sliding or inserting it between the front face of a playing card or trading card and the front panel or front face of a traditional card sleeve. When positioned properly within a card sleeve, the artwork or design on the plastic sheet covers up portions of the artwork or designs on the front face of the playing card or trading card to alter or change the look and appearance of the card.

In yet a third embodiment, the overlay may be used in a sleeve-in-sleeve arrangement. In other words, the altered sleeve with the artwork or design thereon of the first embodiment may itself be inserted into a separate second sleeve which may be completely transparent or altered to have additional artwork or designs on either or both of its front or rear panels.

The overlay of the present invention thus does not change the functionality of the playing card or trading card. Instead, the overlay merely creates aesthetic changes to the front or rear of playing cards or trading cards. In particular, when playing a collectible card game the overlay enables players to further personalize or customize the look and appearance of their favorite cards in their customized deck of cards.

A method of customizing the look and appearance of cards in accordance with the present invention are also disclosed.

DETAILED DESCRIPTION OF THE INVENTION

Figure 1:
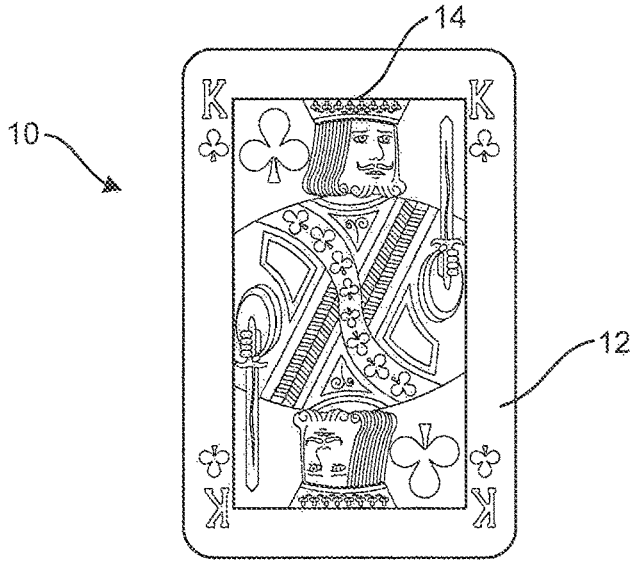
FIG. 1 is a front plan view of a generic playing card illustrating the front face of the king of clubs.

The present invention will now be described with reference to an exemplary card, namely, the king of clubs playing card 10 illustrated in FIG. 1. Those skilled in the art, however, will recognize the present invention is applicable with any type of card such as, but not limited to, (1) any of the fifty two conventional cards in a deck of playing cards used in playing card games such as poker, bridge, euchre, hearts, sheepshead, Uno and other recreational card games; (2) any of the typical trading cards, especially sports trading cards relating to baseball, football, basketball, hockey and other sports; (3) collectible trading cards such as, for example, those used in the game "Magic: The Gathering"; (4) credit cards or debit cards; (5) greeting cards; and (6) other types of cards a person might desire to protect and personalize. Such cards are typically rectangular in shape measuring about 3.5 inches by 2.5 inches, and are composed of a piece of relatively thick, stiff paper such as cardboard or pasteboard, or of a thin plastic sheet material like polypropylene, having printed artwork, graphics or text thereon. Such cards may also have different shapes and dimensions depending on its function. Preferably the present invention is designed for use with trading cards, and most preferably for use with collectible trading cards.

The term "artwork" is meant to be broadly interpreted to mean any designs, pictorial works, graphics, or textual matter in any shape or form. The artwork may be black and white or it may be of the same or multiple different colors.

The king of clubs playing card 10 has a front face 12 imprinted with a standard design found upon each of the cards in a set of playing cards which in the present example of card 10 is the bust of a king having a jeweled crown 14. The card 10 also has a back face 16 imprinted with a generic geometric pattern (not shown) such as diamonds, hearts, flowers, and the like, as is traditional and well known.

Figure 2:
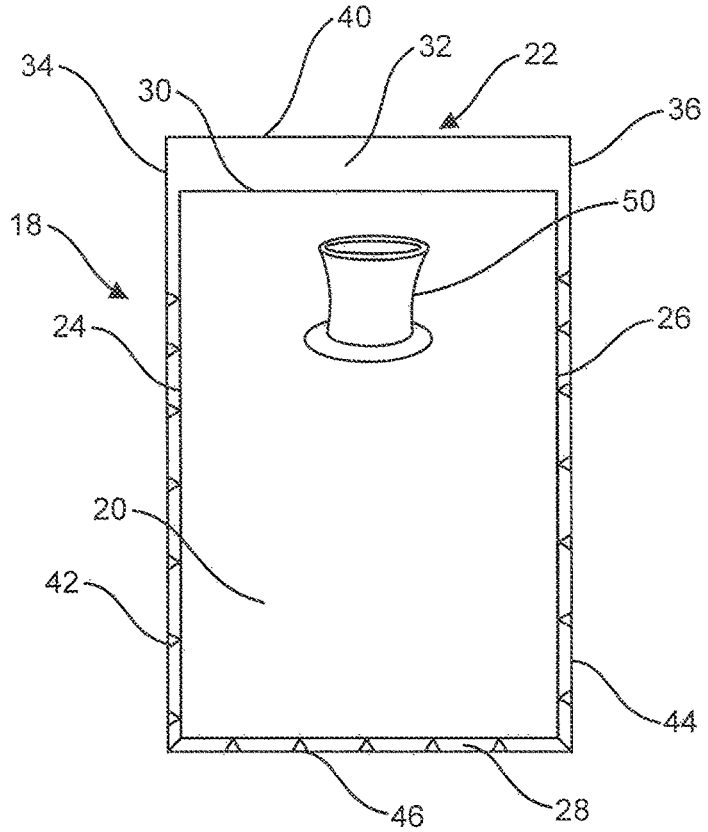
FIG. 2 is a front plan view illustrating a first embodiment of the overlay of the present invention as being the front panel of a transparent card sleeve altered by having artwork in the form of a top hat printed thereon.
Figure 3:
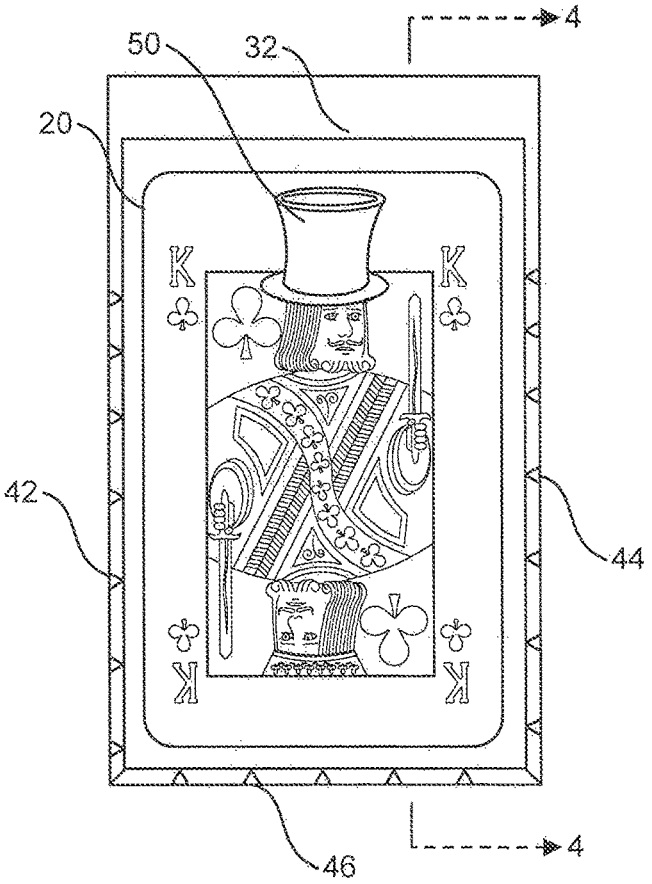
FIG. 3 is a front plan view illustrating the king of clubs playing card of FIG. 1 inserted into the altered card sleeve of FIG. 2 to provide a customized look and appearance to the king of clubs playing card.
Figure 4:
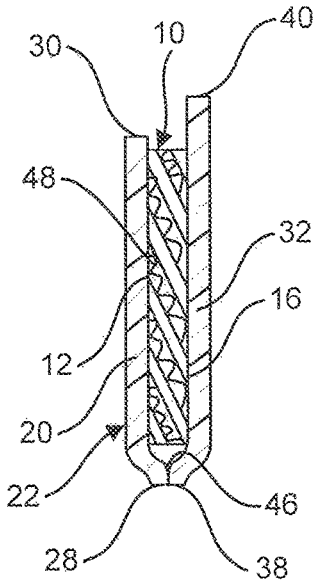
FIG. 4 is an enlarged sectional view taken through the line 4-4 in FIG. 3.

FIG. 2 illustrates an overlay 18 in accordance with a first embodiment of the present invention. Overlay 18 comprises front panel 20 of a conventional card sleeve 22 made of a transparent plastic material such as polypropylene. Card sleeve 22 includes a pair of sleeve panels, namely, front panel 20 and back panel 32. As illustrated in FIGS. 3 and 4, front panel 20 has a pair of opposite side edges 24 and 26, a bottom edge 28, and a top edge 30. Likewise, back panel 32 has a pair of corresponding side edges 34 and 36, bottom edge 38, and top edge 40. A plurality of panel seams 42, 44 and 46 attach front panel 20 to back panel 32 to define a sleeve interior 48 between front panel 20 and back panel 32 which has the approximate dimensions (3.5 inches by 2.5 inches) of a standard size playing card such as the king of clubs 10 so as to snuggly receive card 10 therein. Panel seams 42, 44 and 46 may be heat seals or mechanical seals, and as illustrated, seam 42 attaches the edge margins of side edges 24 and 34, seam 44 attaches the edge margins of side edges 26 and 36, and seam 46 attaches the edge margins of bottom edges 28 and 38 so as to leave the top edges 30 and 40 unattached to provide an opening or slot for permitting card 10 to be slid into the sleeve interior 48 with its front face 12 toward front panel 20, as shown in FIG. 3.

FIG. 2 illustrates front panel 20 of card sleeve 22 has artwork in the form of a top hat 50 imprinted thereon. Top hat 50 is disposed on front panel 20 at a location such that when card 10 is received within the interior 48 of card sleeve 22, top hat 50 covers the jeweled crown 14 of the king illustrated in the king of clubs card 10. Thus, as illustrated in FIG. 3, the aesthetic appearance of the front face 12 of card 10 changes from the king having the jeweled crown 14 to one where the king now has the top hat 50.

As one skilled in the art will recognize, the change from jeweled crown 14 to top hat 50 is only exemplary. Other artwork could be imprinted on the front panel 20 of card sleeve 22, and at different locations, to change or modify other aspects of card 10 resulting in a personalized or customized appearance for card 10 when it is inserted into card sleeve 22.

Figure 5:
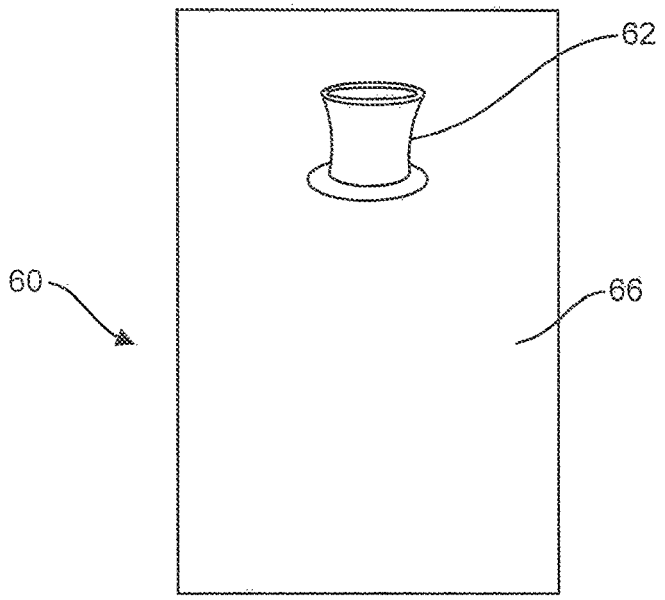
FIG. 5 is a front plan view illustrating a second embodiment of the overlay of the present invention as being a single sheet of thin plastic transparent material altered by having artwork in the form of a top hat printed thereon.
Figure 6:
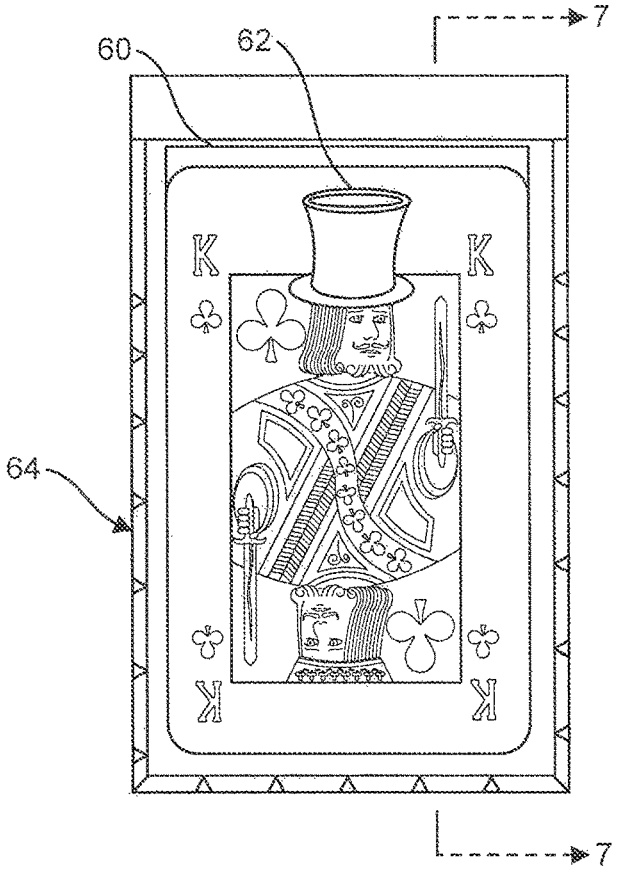
FIG. 6 is a plan view illustrating the king of clubs playing card of FIG. 1 inserted into a standard transparent card sleeve and the single sheet overlay of FIG. 5 inserted into the card sleeve between the front face of the king of clubs and the front panel of the card sleeve to provide a customized look and appearance to the king of clubs playing card.
Figure 7:
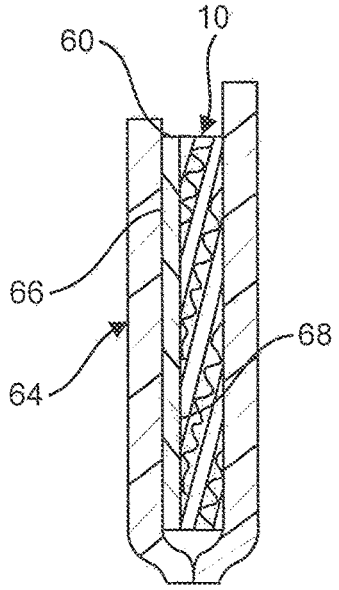
FIG. 7 is an enlarged sectional view taken through the line 7-7 in FIG. 6.

Referring now to FIGS. 5-7, there is illustrated an overlay 60 in accordance with a second embodiment of the present invention. Overlay 60 comprises a single sheet of thin plastic transparent material, such as polypropylene, having artwork in the form of a top hat 62 printed on one side thereof. Overlay 60 has the approximate dimensions (3.5 inches by 2.5 inches) of a standard size playing card such as the king of clubs 10. Top hat 62 is strategically located on overlay 60 so that in use it will cover the jeweled crown 14 of the king of clubs playing card 10 shown in FIG. 1, as will hereinafter be described.

Overlay 60 will typically be used with a conventional card sleeve 64. Card sleeve 64 is constructed in the same manner as card sleeve 22 previously described herein with a front panel 66 attached at its peripheral outer edges to a back panel 68. However, in this embodiment, front panel 66 is preferably completely transparent with no artwork printed thereon.

Overlay 60 is used by sliding or inserting it between front face 12 of the king of clubs playing card 10 and the front panel 66 of card sleeve 64. When positioned properly within card sleeve 64, the top hat 62 of overlay 60 covers up the jeweled crown 14 of the king of clubs 10 to alter or change the look and appearance of the king depicted in the king of clubs playing card 10. Thus, the aesthetic appearance of the front face 12 of the card 10 changes from the king having the jeweled crown 14 to one where the king now haws the top hat 62.

As one skilled in the art will recognize, the change from jeweled crown 14 to top hat 62 is only exemplary. Other artwork could be imprinted on the front panel 66 of card sleeve 64, and at different locations, to change or modify other aspects of card 10 resulting in a personalized or customized appearance for card 10 when it is inserted into card sleeve 64.

Figure 8:
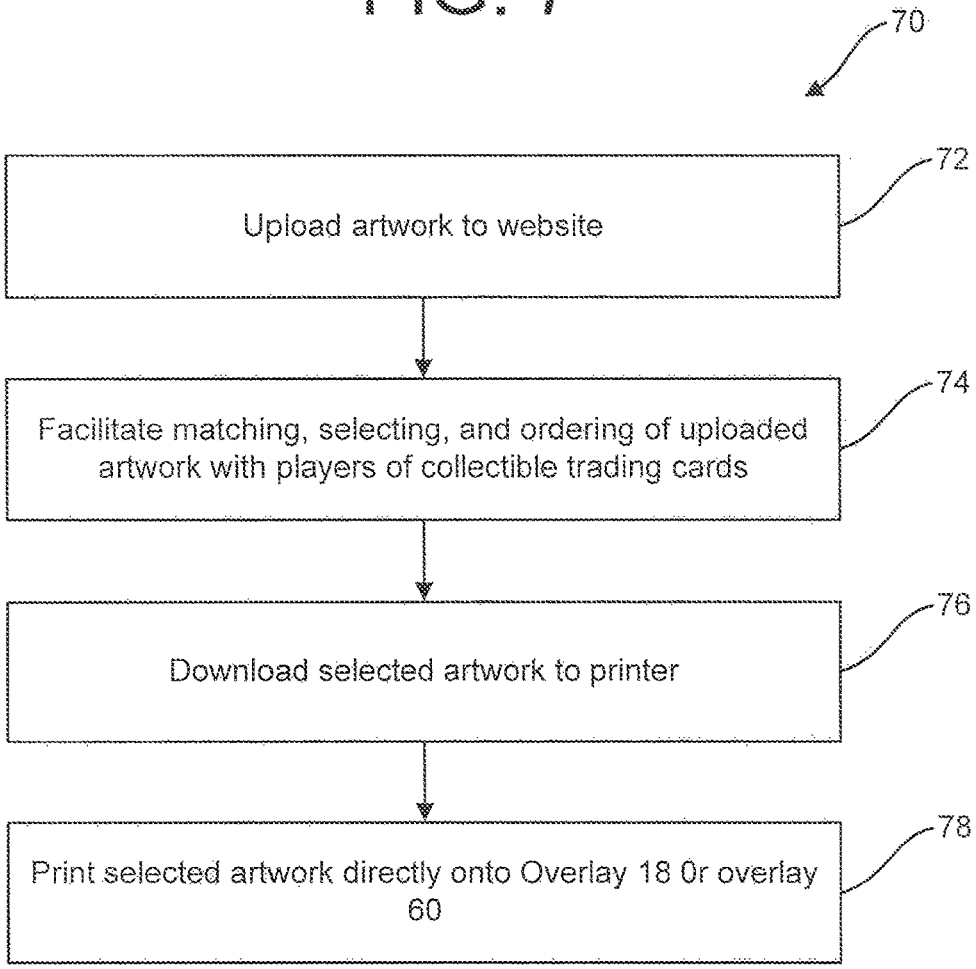
FIG. 8 is a schematic flow diagram of a method of customizing the look and appearance of playing cards and trading cards in accordance with the present invention.

Referring next to FIG. 8 of the drawings, a flow diagram 70 of an exemplary embodiment of an overlay printing method is illustrated. In block 72, artwork designed and created by an artist is uploaded to a website. In block 74, the web-based platform facilitates the matching, selecting, and ordering of one or more of the uploaded artworks with a player who has accessed the website and who desires to personalize or customize collectible trading cards. In block 76, the selected artwork is downloaded to a printer. In block 78, the selected artwork is printed directly onto either overlay 18 or overlay 60.

Figure 9:
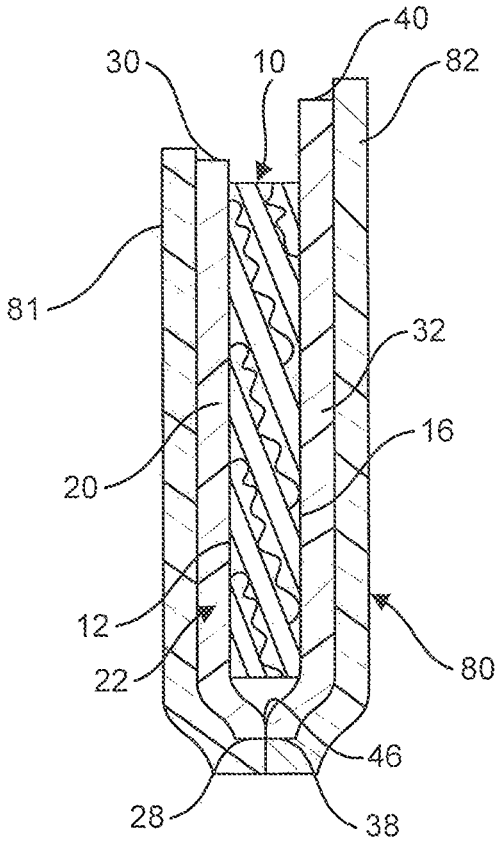
FIG. 9 is an enlarged sectional view similar to FIG. 4 illustrating a third embodiment of the overlay of the present invention as being a sleeve-in-sleeve arrangement where the altered sleeve of FIG. 4 is inserted into a second card sleeve.

Referring now to FIG. 9, there is illustrated a third embodiment where the overlay 18 is used in a sleeve-in-sleeve arrangement. In other words, a first sleeve member comprising the altered sleeve 22 with the artwork or design thereon of the first embodiment may itself be inserted into a separate second sleeve member comprising a second card sleeve 80 for additional protection or customization. Card sleeve 80 may be completely transparent or altered to have additional artwork or designs on either or both of its front panel 81 or rear panel 82. Card sleeve 80 is constructed in the same manner as card sleeve 22 previously described herein with its front panel 81 attached at its peripheral outer edges to its rear panel 82 leaving an open top for slidably receiving the altered card sleeve 22. In this embodiment, front panel 81 of card sleeve 80 is preferably completely transparent with no artwork printed thereon so that the artwork printed on the front panel 20 of altered sleeve 22 may be seen. However, in other embodiments, card sleeve 80 may itself have artwork or designs printed on either or both of panels 81 and 82 to enable additional customization, if desired.

I claim:

1. A card sleeve assembly for protecting as well as customizing the look and appearance of a collectible card used in a collectible card game in a non-permanent manner, comprising:

a collectible card having a front face with a unique design printed thereon, said design providing said card with a certain tactical and functional value when playing said card in a collectible card game;

an outer sleeve member comprising (a) a transparent front panel having opposite side edges, a bottom edge, and a top edge; (b) a rear panel having opposite side edges, a bottom edge, and a top edge; and (c) a plurality of seams attaching the edges of said front and rear panels in such a manner so as to define an interior therein;

an inner sleeve member disposed in the interior of said outer sleeve member, said inner sleeve member comprising (a) a transparent front panel having artwork imprinted thereon that covers only a portion of said front panel, said front panel including opposite side edges, a bottom edge, and a top edge; (b) a back panel having opposite side edges, a bottom edge, and a top edge; and (c) a plurality of seams attaching the edges of said front and back panels in such a manner so as to define an interior for slidably receiving the collectible card therein; and wherein the artwork is printed on said front panel of the inner sleeve in a manner and at a strategic location thereon such that it alters the original look and appearance of the design on the front face of the collectible card, but does not alter the tactical and functional value of the collectible card, when the collectible card is inserted and received within the inner sleeve so that the front panel of the inner sleeve covers the front face of the collectible card.

2. The card sleeve assembly of claim 1 wherein said outer sleeve member comprises a top-loading sleeve member.

3. The card sleeve assembly of claim 1 wherein the rear panel of said outer sleeve member is transparent.

4. The card sleeve assembly of claim 1 wherein the front panel of said outer sleeve member includes artwork imprinted thereon that covers only a portion of said front panel.

5. The card sleeve assembly of claim 1 wherein the back panel of said inner sleeve member is transparent.

6. The card sleeve assembly of claim 1 wherein the back panel of said inner sleeve member is opaque.

* * * * *